US009903335B2

(12) United States Patent
Kinoshita et al.

(10) Patent No.: US 9,903,335 B2
(45) Date of Patent: Feb. 27, 2018

(54) IGNITION DEVICE CONTROLLING STREAMER DISCHARGE AND ARC DISCHARGE

(71) Applicant: DENSO CORPORATION, Kariya, Aichi-pref. (JP)

(72) Inventors: Shota Kinoshita, Nishio (JP); Shinichi Okabe, Nishio (JP); Fumiaki Aoki, Nishio (JP); Akimitsu Sugiura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/285,841

(22) Filed: Oct. 5, 2016

(65) Prior Publication Data

US 2017/0096979 A1 Apr. 6, 2017

(30) Foreign Application Priority Data

Oct. 6, 2015 (JP) ..... 2015-198634

(51) Int. Cl.

| | |
|---|---|
| ***F02P 3/00*** | (2006.01) |
| ***F02P 23/04*** | (2006.01) |
| ***F02P 9/00*** | (2006.01) |
| ***F02P 3/05*** | (2006.01) |
| ***F02P 3/01*** | (2006.01) |
| ***F02P 3/04*** | (2006.01) |
| *F02P 15/10* | (2006.01) |

(52) U.S. Cl.

CPC ..... *F02P 9/002* (2013.01); *F02P 3/01* (2013.01); *F02P 3/0435* (2013.01); *F02P 3/05* (2013.01); *F02P 9/007* (2013.01); *F02P 15/10* (2013.01); *F02P 23/04* (2013.01)

(58) Field of Classification Search

CPC .... F02P 9/002; F02P 9/007; F02P 3/01; F02P 3/0435; F02P 3/05; F02P 15/10; F02P 23/04

USPC ..... 123/605, 618, 620, 623, 628, 143 B

See application file for complete search history.

(56) References Cited

U.S. PATENT DOCUMENTS 6,135,099 A * 10/2000 Marrs ..... F02P 3/0884 123/606

8,453,628 B2 * 6/2013 Mueller ..... F02P 15/08 123/143 B (Continued)

FOREIGN PATENT DOCUMENTS

JP 2014-211148 11/2014

*Primary Examiner* — Hai Huynh

(74) *Attorney, Agent, or Firm* — Nixon & Vanderhye PC

(57) ABSTRACT

An ignition device includes: an ignition plug producing plasma discharge between a pair of discharge electrodes of an ignition plug; an ignition coil provided with a primary coil and a secondary coil, the secondary coil applying voltage between the pair of discharge electrodes; a voltage applying unit applying alternating current voltage to the primary coil, a frequency of the alternating current voltage being set to produce voltage resonance in a circuit including the ignition plug and the secondary coil. The voltage applying unit sets an output period of the alternating current voltage to be longer than a first period at which a partial breakdown start to occur at the pair of discharge electrodes, and shorter than a second period at which a total breakdown occurs at the pair of discharge electrodes, when an air/fuel ratio is lower than a predetermined threshold.

11 Claims, 7 Drawing Sheets

(56) References Cited

U.S. PATENT DOCUMENTS

| | | | | |
|---|---|---|---|---|
| 9,484,719 | B2 * | 11/2016 | Zheng | H01T 19/04 |
| 2013/0181629 | A1 | 7/2013 | Urushihara et al. | |

* cited by examiner

IGNITION DEVICE CONTROLLING STREAMER DISCHARGE AND ARC DISCHARGE

CROSS-REFERENCE TO RELATED APPLICATION

This application is based on and claims the benefit of priority from earlier Japanese Patent Application No. 2015-198634 filed Oct. 6, 2015, the description of which is incorporated herein by reference.

BACKGROUND (Technical Field)

The present disclosure relates to an ignition device of an engine. More particularly, the present disclosure relates to an ignition device of an engine controlling streamer discharge and arc discharge.

(Description of the Related Art)

An ignition device of an engine supplies a primary current to a primary coil electrically connected to a power source so as to store magnetic energy in an ignition coil. Then, a secondary current is induced when the primary current is cutoff. Allowing the secondary current to flow between a gap formed between a center electrode and a ground electrode of an ignition plug, spark discharge occurs at the gap. As another type of ignition device, a configuration is provided in which high frequency current is made to flow through the above-mentioned spark discharge path via a diode, thereby producing spark discharge having a high energy and discharge plasma in wider area than the normal discharge.

In such ignition devices, since a large amount of current is required so as to increase an area of the discharge plasma, there has been a problem that the electrode is consumed significantly faster. To solve this problem, JP-A-2014-211148 discloses a technique, that is, discharge is cutoff before the temperature of the electrode reaches a melting temperature of the metal, and current is allowed to flow again, and this process is repeatedly performed, thereby minimizing consumption of the electrode.

According to the technique disclosed by the above-mentioned patent literature, electrode consumption is suppressed by repeating the above-described process several times. However, in a view of the electrode consumption, this technique still has to be improved.

SUMMARY

The present disclosure is achieved in light of the above-described circumstances and to provide an ignition device capable of reducing consumption of electrode included in an ignition plug.

An ignition device according to the present disclosure includes: an ignition plug that produces plasma discharge between a pair of discharge electrodes so as to ignite a combustible mixture in a combustion chamber of an internal combustion engine; an ignition coil provided with a primary coil and a secondary coil, the secondary coil applying voltage between the pair of discharge electrodes of the ignition plug; a voltage applying unit that applies alternating current voltage to the primary coil, a frequency of the alternating current voltage being set so as to produce voltage resonance in a circuit including the ignition plug and the secondary coil. The voltage applying unit sets an output period of the alternating current voltage to be longer than a first period at which a partial breakdown start to occur due to a discharge at the pair of discharge electrodes, and shorter than a second period at which a total breakdown occurs due to a discharge at the pair of discharge electrodes, when an air/fuel ratio of the internal combustion engine is lower than a predetermined threshold.

According to a conventional device, the ignition signal is transmitted to a switching element, and this switching element is controlled based on the received ignition signal. By this control, a primary current flowing into the primary coil is cutoff and high voltage is induced in the secondary coil so that spark discharge is produced. High frequency current is allowed to flow into the conduction path of the spark discharge so that discharge plasma is formed spreading in an area wider than that of regular spark charge. In this type of ignition device, a large amount of current is required in order to widely spread the discharge plasma. Accordingly, there is a concern that electrodes included in the ignition plug may be consumed faster.

To minimize the consumption of the electrodes and to secure ignitability of the fuel, the ignition device is provided with a voltage applying unit. This voltage applying unit applies alternating current voltage to the primary coil, where the alternating current voltage has a frequency that causes voltage resonance in a circuit including the ignition plug and the secondary coil. At this time, when the air/fuel ratio of the internal combustion engine is lower than the threshold, i.e. the air/fuel ratio is on a rich side, fuel is combustible with a streamer discharge having a fibrous shape. Therefore, the output period of the alternating current voltage is set to be longer than the first period at which a partial breakdown start to occur (streamer discharge occurs) due to a discharge at the pair of discharge electrodes, and shorter than the second period at which a total breakdown occurs (glow or arc discharge occurs) due to a discharge at the pair of discharge electrodes, when an air/fuel ratio of the internal combustion engine is lower than a threshold. Thus, a streamer discharge is performed when the air/fuel ratio is determined to allow the fuel to combust.

The streamer discharge is a nonequilibrium plasma. Accordingly, electrons in the plasma have high temperature, but ion temperature of the fuel gas in the plasma is low. If there were an arc discharge with equilibrium plasma, the ion temperature of the fuel gas in the plasma would be high, similar to that of electrons in plasma, and the discharge electrodes of the ignition plug would be exposed to high temperature, thereby possibly causing consumption of the electrodes. Accordingly, when the air/fuel ratio of the internal combustion engine is lower than the threshold for a rich side, a streamer discharge is performed for the fuel combustion, whereby the discharge electrodes of the ignition plug can be prevented from being frequently exposed to a high temperature environment and consumption of the electrodes can be minimized.

DETAILED DESCRIPTION OF PREFERRED EMBODIMENTS

Figure 1:
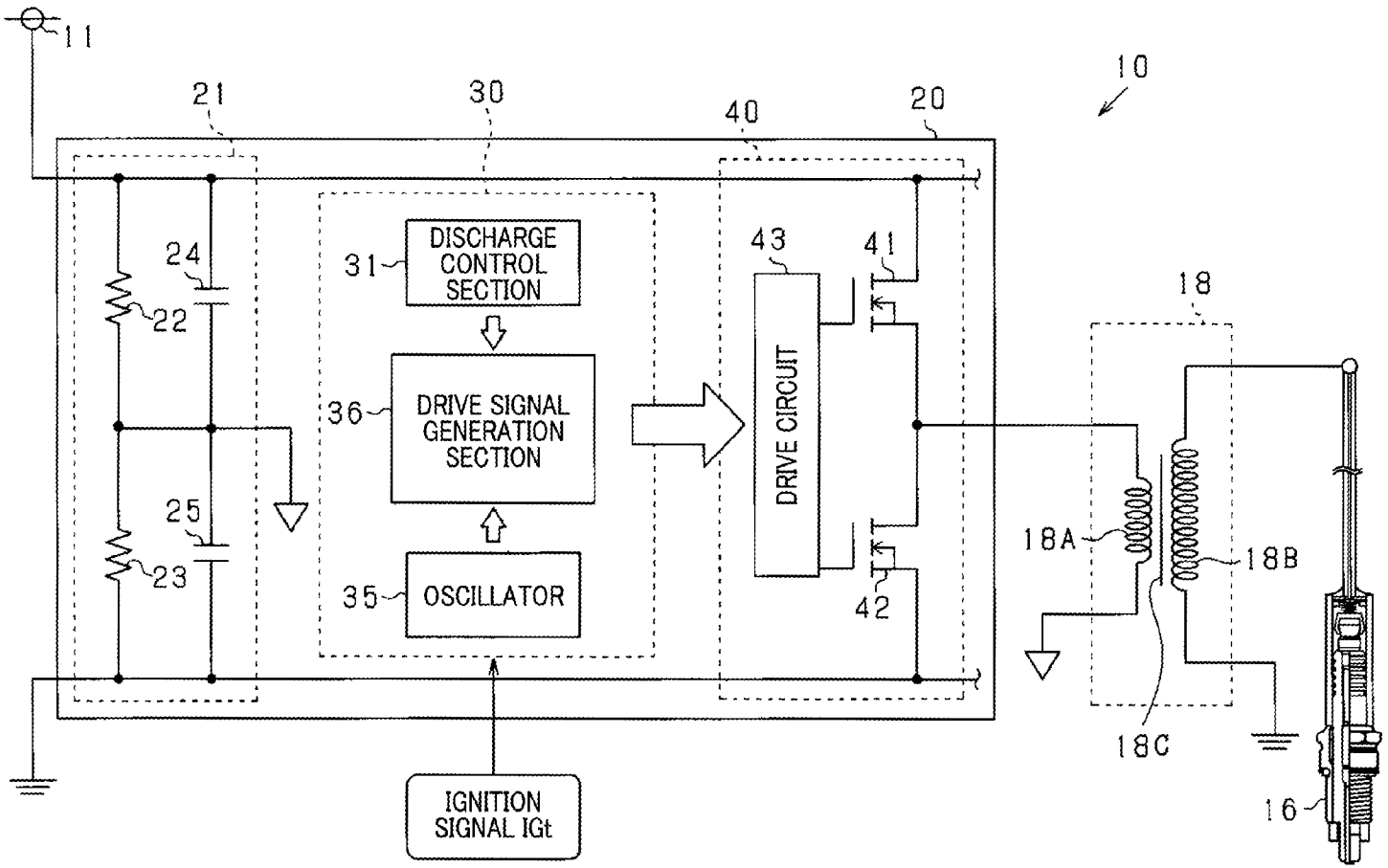
FIG. 1 is an overall configuration of an ignition control system according to the present embodiment.

Hereinafter, with reference to the drawings, an embodiment of the present disclosure will be described. An ignition control system 10 shown in FIG. 1 is provided with an ignition coil 18, an ignition plug 16, a high frequency power source 20 and a power supply unit 11. The ignition coil 18 is provided with a primary coil 18A, a secondary coil 18B and an iron core 18C. The first end of the primary coil 18A is electrically connected to an output terminal of the high frequency power source 20. The high frequency power source 20 converts voltage outputted by the power supply unit 11 to alternating-current (AC) voltage to be applied to the primary coil 18A. The first end of the secondary coil 18B is connected to an input terminal of the ignition plug 16. The second end of the secondary coil 18B is connected to the ground potential. In other words, the secondary coil 18B is connected to the ignition plug 16. Hence, high voltage is applied to the ignition plug 16 by the secondary coil 18.

The high frequency power source (corresponding to voltage applying unit) 20 is provided with a power dividing unit 21, a signal generation unit 30 and a switching unit 40. The power dividing unit 21 includes a series-connected resistor composed of resistors 22 and 23 and a series-connected capacitor composed of capacitors 24 and 25. The connection point between the resistor 22 and the resistor 23 and the connection point between the capacitor 24 and the capacitor 25 have the same potential as that of the second end of the primary coil 18A. The voltage V is applied to one ends of the resistor 22 and the capacitor 24 by the power supply unit 11, and one ends of the resistor 23 and the capacitor 25 are connected to the ground.

Figure 2:
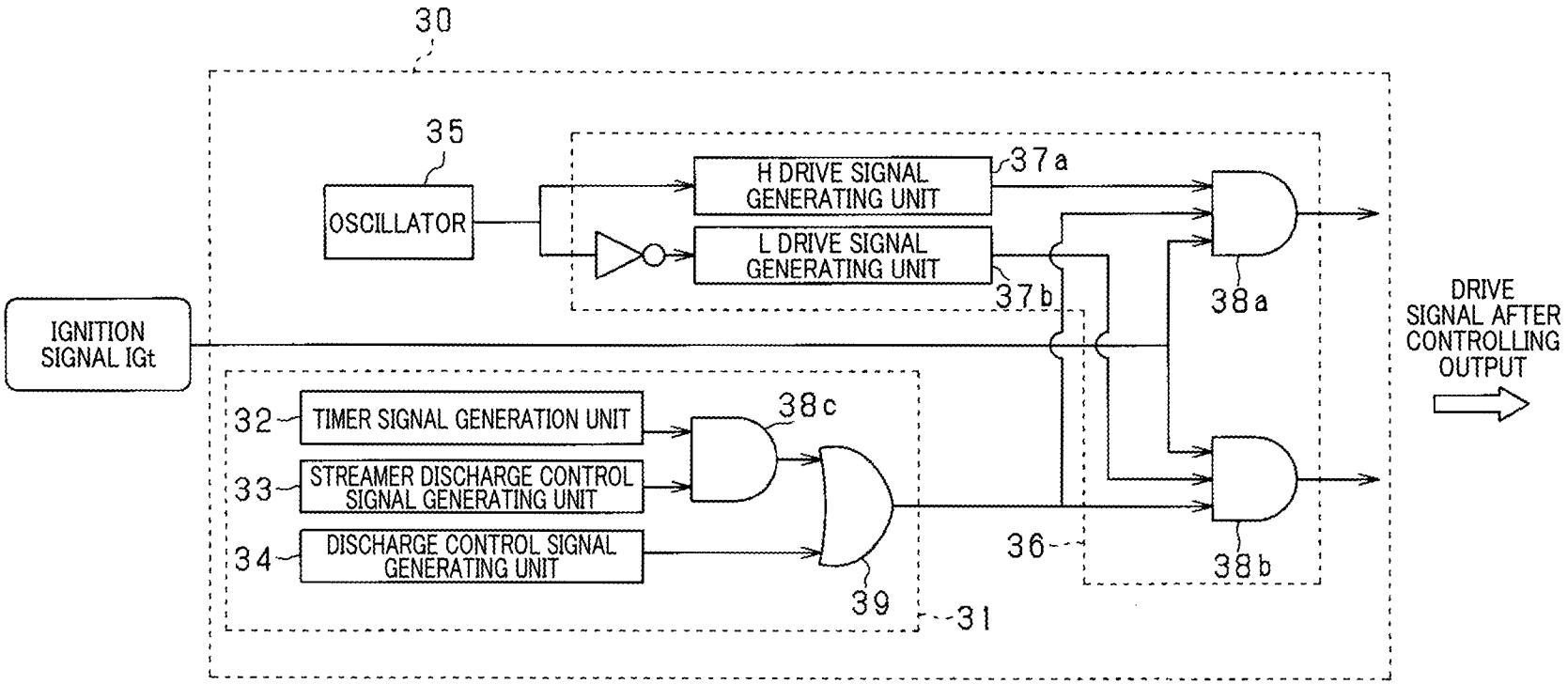
FIG. 2 is an overall configuration of a signal generating unit according to the present embodiment.

FIG. 2 provides a detailed configuration of the signal generation unit 30. The signal generation unit 30 includes a discharge control section 31, an oscillator 35 and a drive signal generation section 36.

The oscillator 35 and the drive signal generation section 36 are electrically connected. The oscillator 35 generates a pulse-wave voltage signal of which the state changes between Hi and Low levels. According to the present embodiment, the voltage signal is generated such that the frequency (resonance frequency) of the AC voltage produces a voltage resonance of a circuit including the ignition plug 16 and the secondary coil 18B. Specifically, the voltage signal is generated to set the frequency thereof to approximately 800 KHz in order to produce a voltage resonance. The voltage signal is transmitted to an H drive signal generating unit 37*a* included in the drive signal generation section 36. At the same time, the voltage signal is transmitted to a L drive signal generation unit 37*b* via an inverter. The H drive signal generation unit 37*a* generates a drive signal H which is outputted to a first AND circuit 38*a*. The L drive signal generation unit 37*b* generates a drive signal L which is outputted to a second AND circuit 38*b*. These first and second AND circuit receives an ignition signal IGt other than the above drive signals.

It is assumed that a signal of the discharge control section 31 is not transmitted to the first and second circuits 38*a* and 38*b*.

The first and second AND circuits 38*a* and 38*b* receive the ignition signal IGt so as to transmit the drive signals H and L to the drive circuit 43. Then, the drive circuit 43 controls, based on the received drive signals H and L, a first switching element 41 and a second switching element 42. By this control, for example, when the first switching element 41 is turned ON and the second switching element is turned OFF, a positive voltage +V is applied to the primary coil 18A by the power supply unit 11. On the other hand, when the first switching element 41 is turned OFF, and the second switching element 42 is turned ON, a negative voltage −V is applied to the primary coil 18A from the capacitor 25. Therefore, the first switching element 41 and the second switching element 42 are switched between ON and OFF, positive voltage or negative voltage is alternately applied to the primary coil 18A.

According to the present embodiment, the frequency of the alternating current (AC) voltage is set to approximately 800 KHz as a resonant frequency. Hence, by applying a high frequency AC voltage to the primary coil 18*a*, spark discharge having a high energy and discharge plasma in a wider area than normal discharge can be formed on the ignition plug 16.

According to the present embodiment, to improve the effect of minimizing consumption of the electrodes, the discharge control section 31 is additionally provided in the signal generation unit 30. The discharge control section 31 is used for controlling discharge occurring at the ignition plug 16. Specifically, the discharge control section 31 generates a surface streamer discharge or a surface arc discharge. The discharge control section 31 will be later described in detail.

Figure 3:
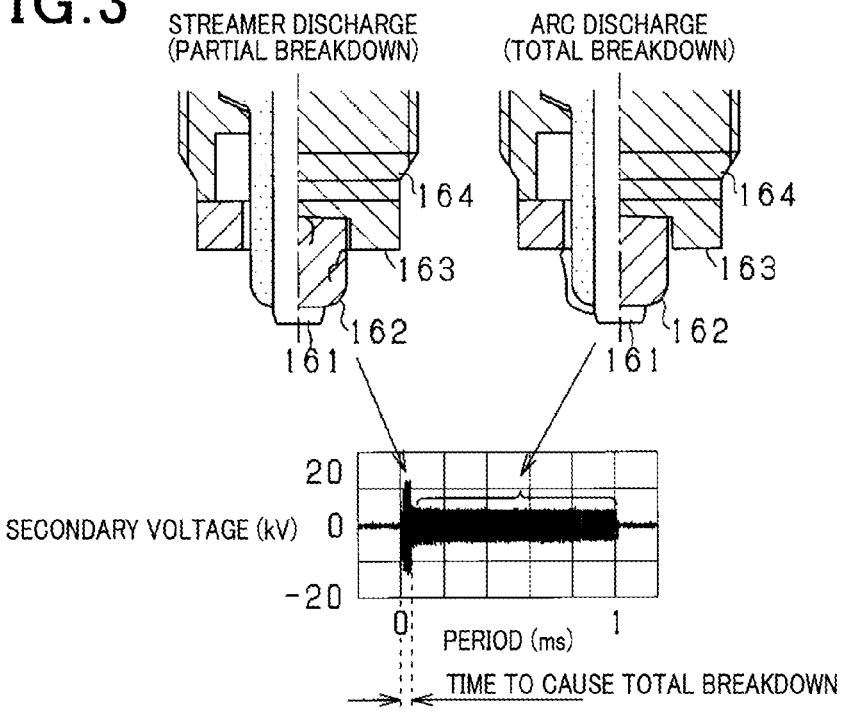
FIG. 3 is a graph showing a difference between a surface streamer discharge and a surface arc discharge.
Figure 4:
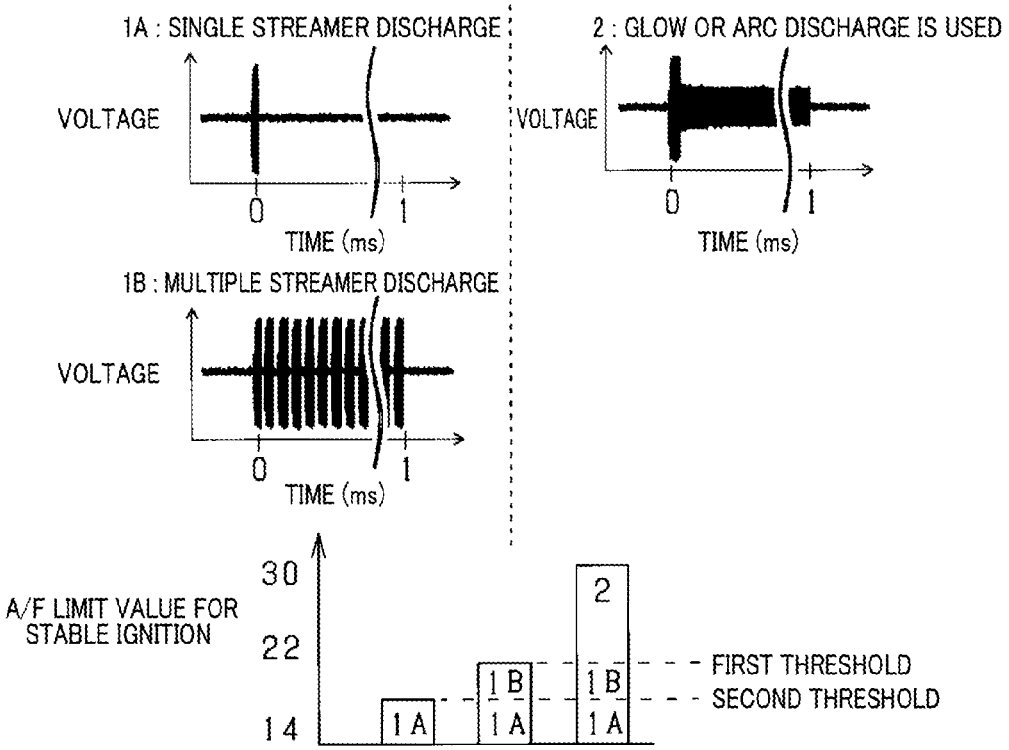
FIG. 4 is a graph illustrating a present difference among air-fuel ratios capable of combusting the fuel, depending on types of discharge.

With reference to FIG. 3, an overall configuration of the ignition plug 16 will be described. The ignition plug 16 is provided with a center electrode 161, an insulator 162 (insulator), a ground electrode 163 and a housing 164. The insulator 162 covers outer periphery of the center electrode 161 to ensure an electrical insulation between the center electrode 161, and the housing 164 and the ground electrode 163. A base end side of the insulator 162 is fixed by the housing 164 with a caulking. A discharge space is provided for discharging between the insulator 162 and the electrode 163 which are being exposed from the housing 164. The surface streamer discharge occurs in the discharge space.

As shown in lower part of FIG. 3, the surface streamer discharge starts to occur when the secondary voltage exceeds around 10 kV, such that the discharge extends towards the center electrode 161 along the insulator 162 from a surface of the ground electrode 163 (i.e., partial breakdown). When the surface streamer discharge continues to discharge, the discharge spreads along the surface of the insulator 162 and a part of the discharge reaches a tip end of the center electrode 161 (total breakdown). When the total breakdown occurs, the surface arc discharge is formed between the ground electrode 163 and the center electrode 161.

The inventors of the present invention have discovered that the surface streamer discharge enables fuel combustion when the A/F ratio is in a rich state. The surface streamer discharge occurs by nonequilibrium plasma. Accordingly, the temperature of electrons in the plasma is high, but ion temperature of the fuel gas is low. Accordingly, when the A/F ratio of the internal combustion engine is lower than a predetermined threshold, indicating a rich state, streamer discharge is performed to combust the fuel, whereby the discharge electrodes of the ignition plug 16 can be prevented from being frequently exposed to high temperature environment and consumption of the electrode can be minimized.

Further, the inventors of the present invention have discovered that an appropriate range of the A/F ratio capable of enabling stable combustion differs among cases: i) single surface streamer discharge is performed, ii) multiple surface streamer discharges are performed and iii) surface arc discharge is performed. Specifically, comparing with the case i) where single surface streamer discharge is performed, when the multiple surface streamer discharges is performed stable fuel combustion can be performed even when the A/F ratio is more in a lean state. Moreover, comparing with the case ii) where multiple surface streamer discharges are performed, when the surface arc discharge is performed, stable fuel combustion can be performed even when the A/F ratio is more in a lean state. In this respect, a first threshold is defined as an upper limit value of the A/F ratio capable of enabling stable combustion when the multiple surface streamer discharges are performed. Likewise, a second threshold is defined as an upper limit value of the A/F ratio capable of enabling stable combustion when the single surface streamer discharge is performed. Thus, appropriate type of discharge can be selected on the basis of a comparison between the actual A/F ratio and the first and second threshold values.

Taking the above-described things into consideration, as shown in FIG. 2, the discharge control section 31 includes a timer signal generation unit 32, a streamer discharge control signal generating unit 33 and a discharge control signal generating unit 34.

The streamer discharge control signal generating unit 33 controls the discharge period of the surface streamer discharge to avoid the total breakdown by enabling continuous surface streamer discharge. Specifically, an output period of the AC voltage is set to be longer than a first period at which a partial breakdown start to occur due to a discharge at the discharge electrode (i.e., streamer discharge occurs), and shorter than a second period at which a total breakdown occurs due to a discharge at the discharge electrodes (i.e., arc discharge occurs). According to the present embodiment, the second period is set to be 20 μsec.

Therefore, the streamer discharge control signal generating unit 33 outputs a high signal during a period longer than the first period and shorter than the second period. When the second period elapses, the streamer discharge control signal generating unit 33 outputs a low signal so as to avoid a total breakdown. The output period for the low signal is set as a period where the secondary voltage is decreased not to cause the total breakdown of discharge in the ignition plug 16 even when the high signal is outputted again for a period longer than the first period and shorter than the second period.

The timer signal generation unit 32 is used to determine, based on the A/F ratio of the air-fuel mixture, a period enabling the surface streamer discharge (i.e., whether a single surface streamer discharge or a multiple surface streamer discharges is performed). Therefore, the timer signal generation unit 32 outputs a high signal during a period enabling the surface streamer discharge, and outputs a low signal during a period disabling the surface streamer discharge.

Each of the output signals outputted by the timer signal generation unit 32 and the streamer discharge control signal generating unit 33 is received by a third AND circuit 38*c*. By using the received signal, the AND circuit 38*c* outputs a signal to an OR circuit 39.

Meanwhile, the discharge control signal generating unit 34 determines whether or not a surface arc discharge or a surface streamer discharge should be performed, based on the A/F ratio of the air-fuel mixture. The high signal is outputted to the OR circuit 39 when the A/F ratio is in a lean state and the surface arc discharge is selected, and the low signal is outputted to the OR circuit 39 when the A/F ratio is in a rich state and the surface streamer discharge is selected.

Figure 8:
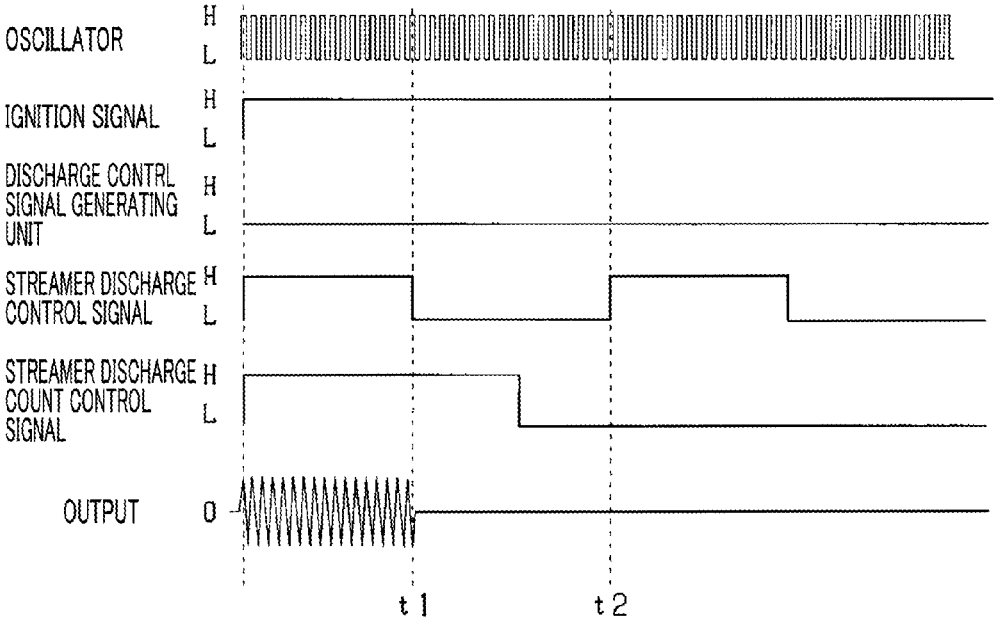
FIG. 8 is a timing diagram showing an operation of an ignition system according to the present embodiment.

Hereinafter, a case is described in which among signals received by the OR circuit 39, when a signal outputted by the discharge control signal generating unit 34 is low signal, and a surface streamer discharge is required. In this case, as shown in FIG. 8, signals of the timer signal generation unit 32 and the streamer discharge control signal generating unit 33 are transmitted to the first AND circuit 38*a* and the second AND circuit 38*b*. The first AND circuit 38*a* and the second AND circuit 38*b* receive the ignition signal IGt, the drive signals H and L, and a signal outputted by the OR circuit 39, and outputs logical AND signal of these received signals to the drive circuit 43. The drive circuit 43 controls the first switching element 41 and the second switching signal 42 based on the signals from the timer signal generation unit 32 and the streamer discharge signal generation unit 33, thereby controlling a timing and a period for applying the AC voltage to the primary coil 18A. More particularly, the timer signal generation unit 32 determines a period for applying the AC voltage to the primary coil 18A. In the determined period, the streamer discharge signal generation unit 33 determines a timing for applying the AC voltage to the primary coil 18A such that the discharge causes a partial breakdown and does not cause a total breakdown. Accordingly, the discharge control section 31 is included in the signal generation unit 30, whereby a discharge state (surface streamer discharge or surface arc discharge) of the ignition plug 16 can be arbitrarily controlled.

On the other hand, a case is described in which among signals received by the OR circuit 39, when a signal outputted by the discharge control signal generating unit 34 is high signal, and a surface arc discharge is required. In this case, the OR circuit 39 outputs high signal to the first AND circuit 38*a* and the second AND circuit 38*b*, in response to high input signal transmitted by the discharge control signal generating unit 34. Hence, unlike the surface streamer discharge, since the period for applying AC voltage to the primary coil 18A is not restricted, the discharge in the ignition plug 16 reaches a total breakdown so that the surface arc discharge occurs.

Figure 5:
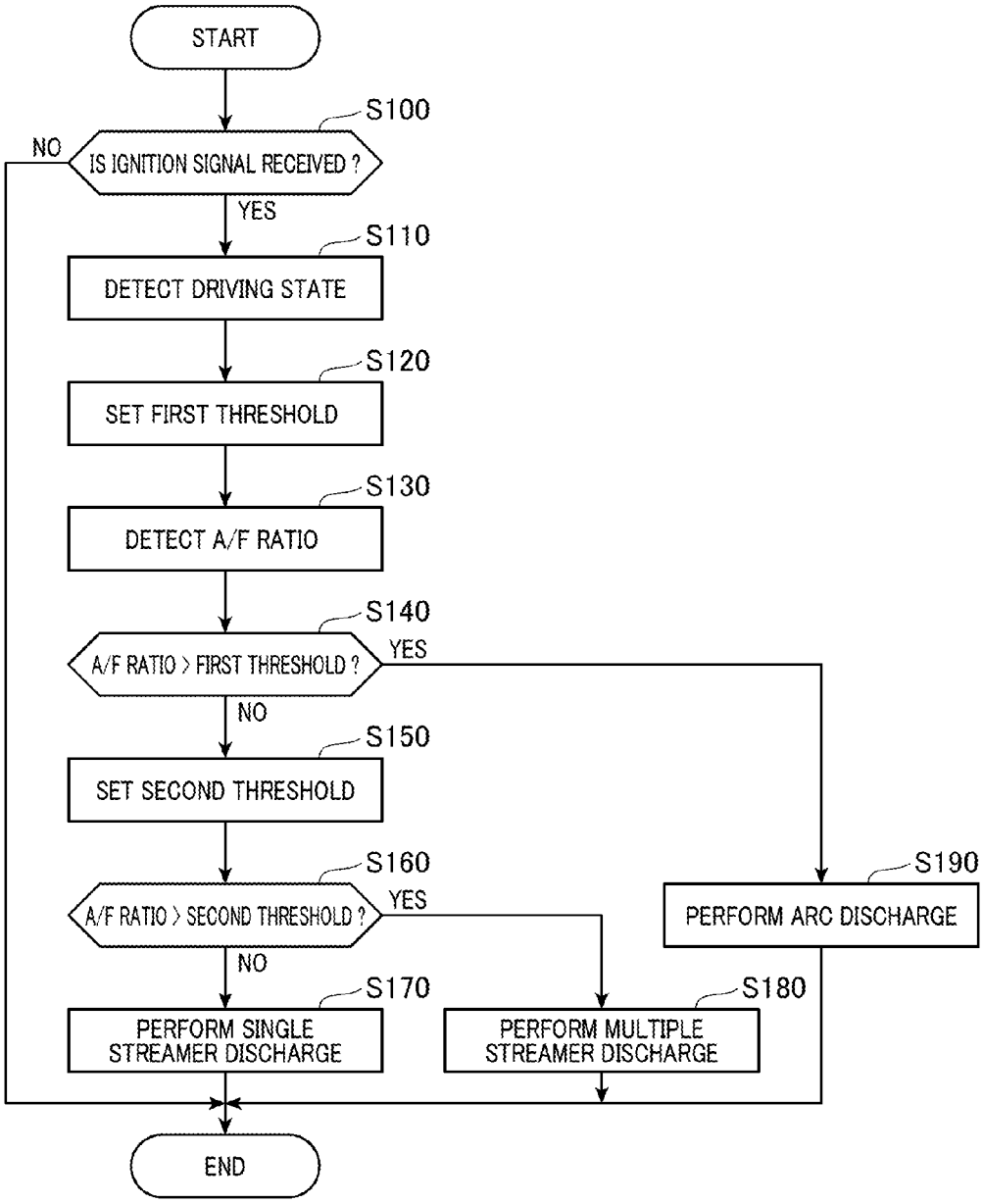
FIG. 5 is a flowchart showing a process of a discharge control according to the present embodiment.

According to the present embodiment, the signal generation unit 30 executes a discharge control shown in FIG. 5. The discharge control shown in FIG. 5 is repeatedly executed at predetermined period by the signal generation unit 30 during the signal generation unit 30 being powered ON.

At step S110, it is determined whether or not the first AND circuit 38*a* and the second AND circuit 38*b* receives the ignition signal IGt which is an external signal. When the ignition signal IGt is not received (S100: NO), since spark discharge of the ignition plug 16 is not required, the process is terminated. When the ignition signal IGt is received (S100: YES), since spark discharge of the ignition plug 16 is required, the process proceeds to step S110.

At step S110, the discharge control signal generating unit 34 receives information about a current driving state of the vehicle from an external unit. The driving state according to the present embodiment corresponds to a load of the internal combustion engine based on an accelerator input or the like, a rotational speed of an output shaft in the internal combustion engine or the like. When the load of the internal combustion engine becomes larger, a pressure in the cylinder (cylinder pressure) becomes high. In this case, it is difficult to produce discharge at the ignition plug 16. When the rotational speed of the internal combustion engine is high, discharge is likely to extend due to air-flow in the cylinder so that an air-fuel mixture can readily ignite even with a short period of discharge.

Therefore, the A/F ratio capable of enabling stable combustion with the surface streamer discharge varies depending on an amount of the load and the rotational speed of the internal combustion engine. Accordingly, at step S120, the discharge control signal generating unit 34 sets the first threshold based on the driving state detected at step S110. For example, when the load of the internal combustion engine is low or the rotational speed of the internal combustion engine is high, the first threshold is higher i.e., towards the lean side.

At step S130, the discharge control signal generating unit 34 controls the A/F sensor provided in an upper stream side of the exhaust catalyst to detect actual A/F ratio of the air-fuel mixture.

At step S140, the discharge control signal generating unit 34 determines whether or not the actual A/F ratio is larger than the first threshold. When it is determined that the actual A/F ratio is less than or equal to the first threshold (S140: NO), the process determines that the surface streamer discharge can be used for combusting fuel and proceeds to step S150.

At step S150, the timer signal generation unit 32 sets the second threshold based on the driving state. Similar to the first threshold, the second threshold is a variable value which varies depending on a load of the internal combustion engine or a rotational speed of the internal combustion engine. The second threshold value is set to be lower than the first threshold.

At step S160, the timer signal generation unit 32 determines whether or not the actual A/F ratio is larger than the second threshold. When the actual A/F ratio is less than or equal to the second threshold (S160: NO), the process determines that the single surface streamer discharge can enable fuel combustion, and proceeds to step S170. At step S170, the timer signal generation unit 32 sets a discharge period corresponding to a case where single streamer discharge is performed, enabling the ignition plug 16 to generate the surface streamer discharge, and terminates the procedure.

Figure 6:
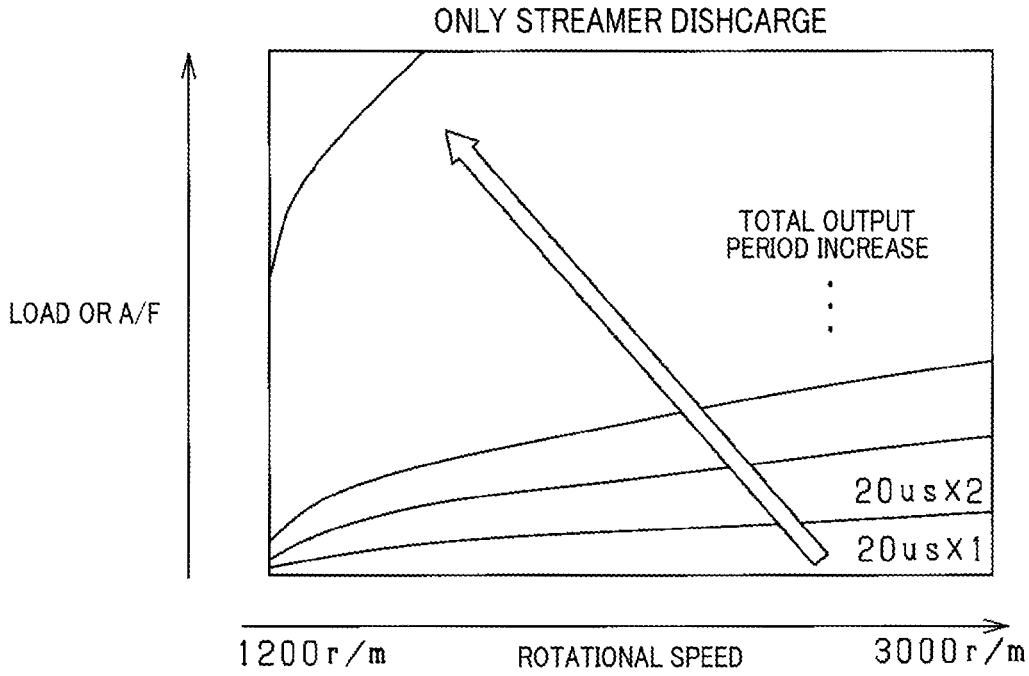
FIG. 6 is a graph showing a rotation speed and a load of an internal combustion engine which influence a discharge period necessary for fuel-combustion.

When the actual A/F ratio is larger than or equal to the second threshold (S160: YES), it is determined that multiple surface streamer discharges can be used for fuel combustion, and proceeds to step S180. At step S180, the timer signal generation unit 32 sets the discharge period corresponding to a case where multiple streamer discharge is performed, enabling the ignition plug 16 to generate the surface streamer discharge and terminates the procedure. As shown in FIG. 6, the discharge period of the surface streamer discharge is set such that the larger the load of the internal combustion engine and the lower the rotational speed of the internal combustion engine, the longer (more) the discharge period (the number of times) is. Also, when the A/F ratio is larger, i.e. more towards a lean side, since the fuel is hard to combust, a longer discharge period is required.

Figure 7:
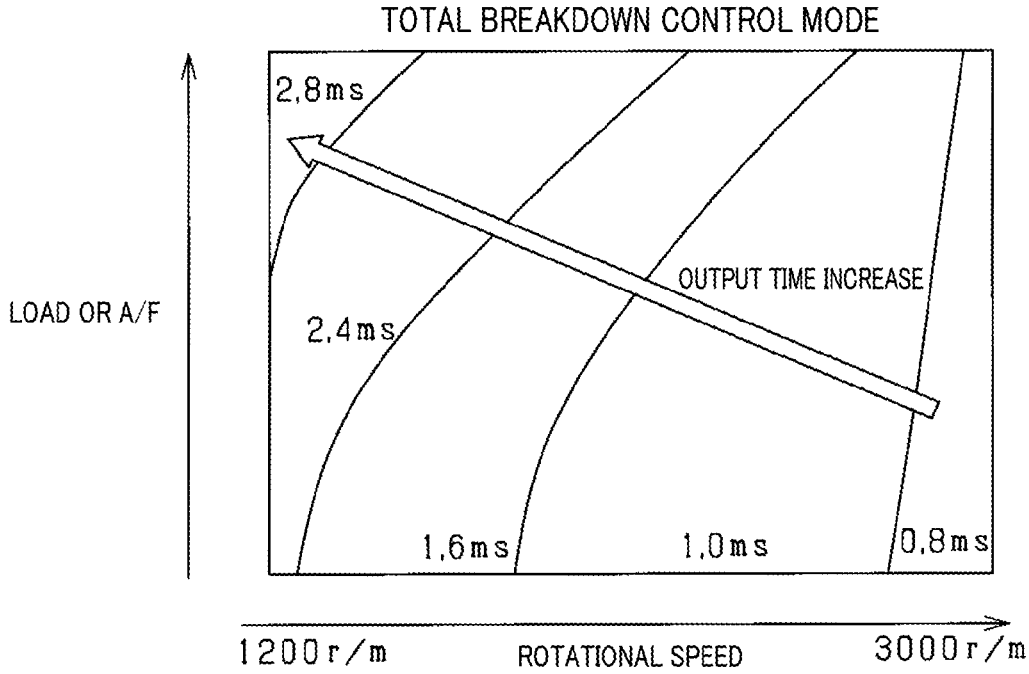
FIG. 7 is a graph showing a rotation speed and a load of an internal combustion engine which influence a discharge period necessary for fuel-combustion.

When the actual A/F ratio is larger than or equal to the first threshold (S140: NO), the process determines that the surface arc discharge is required to combust the fuel, and proceeds to step S190. At step S190, the discharge control signal generating unit 34 allows the ignition plug 16 to generate the surface streamer discharge continuously so as to cause a total breakdown, whereby arc discharge occurs. Then the process terminates the procedure. As shown FIG. 7, the discharge period of the surface arc discharge shows similar characteristics to the surface streamer discharge. That is, the discharge period necessary for combusting the fuel is set to be longer as the load of the internal combustion engine becomes larger and the rotational speed thereof becomes lower. Further, since when the A/F ratio becomes high, i.e. more towards a lean side, the fuel combustion is difficult to perform. For this reason, the discharge period is set to be longer.

With reference to FIG. 8, discharge control according to the present embodiment will be described as follows.

The signal from the oscillator 35 passes through the H drive signal generating unit 37*a* and the L drive signal generating unit 37*b*, whereby drive signals H and L are always transmitted to the first AND circuit 38*a* and the second AND circuit 38*b*. Also, the ignition signal IGt is externally transmitted to the first AND circuit 38*a* and the second AND circuit 38*b*.

On the other hand, the discharge control signal generating unit 34 sets the first threshold based on the driving state of the internal combustion engine. When the actual A/F ratio is less than or equal to the first threshold, since the surface streamer discharge can be performed, the discharge control signal generating unit 34 outputs a low signal to the OR circuit 39.

The streamer discharge control signal generating unit 33 controls the period for applying voltage to the primary coil 18A using a high/low signal, not to cause the surface arc discharge due to total breakdown from the surface streamer discharge.

The timer signal generation unit 32 controls a period where the surface streamer discharge is repeatedly performed, by using the high/low signal. A logical AND of these signals of the timer signal generation unit 32 and the streamer discharge control signal generating unit 33 is outputted to the OR circuit 39. The OR circuit 39 outputs a logical OR of this logical AND result and the low signal of the discharge control signal generating unit 34, to the first AND circuit 38*a* and the second AND circuit 38*b*.

The first AND circuit 38*a* and the second AND circuit 38*b* receive respective drive signals H and L, the ignition signal IGt and output of the OR circuit 39, and a logical AND result of these signals is outputted to the drive circuit 43. In response to the outputted signal received by the drive circuit 43, the drive circuit 43 controls the first switching element 41 and the second switching element 42 so as to apply AC voltage to the primary coil 18A, thereby enabling the ignition plug 16 to generate the surface streamer discharge.

As shown in FIG. 8, the surface streamer discharge is terminated within a period shorter than a predetermined discharge period determined by the timer signal generation unit 32 (see time t1). This is because the streamer discharge control signal generating unit 33 stopped applying voltage to the ignition coil 18, since is it considered that surface arc discharge may occur if the surface streamer discharge continues more.

In FIG. 8, a case is expected where the actual A/F ratio is less than or equal to the second threshold. Hence, a streamer discharge has not occurred since time t1. Here, assuming the actual A/F ratio is more than or equal to the second threshold and less than or equal to the first threshold, the discharge period determined by the timer signal generation unit 32 is set to be longer than a time (see time t2) when the streamer discharge control signal generating unit 33 again outputs the high signal, whereby second surface streamer discharge is performed.

According to the above-described configuration, the present embodiment can obtain the following advantageous effects.

Figure 9:
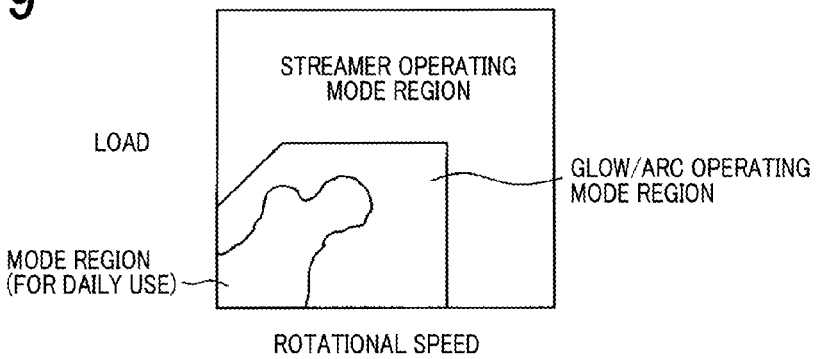
FIG. 9 is graph illustrating an effect of discharge control according to the present embodiment.
Figure 9:
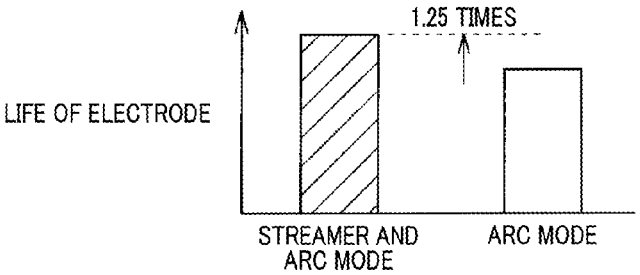

When the actual A/F ratio is less than or equal to the first threshold, the fuel is combustible with a surface streamer discharge having fibrous shape. Accordingly, the surface streamer discharge is performed to attempt the fuel combustion as long as the A/F ratio is within a range where fuel combustion can be performed with the surface streamer discharge. In this case, the surface streamer discharge occurs by nonequilibrium plasma. Therefore, when the A/F ratio of the internal combustion engine is less than or equal to the first threshold, the surface streamer discharge is performed for the fuel combustion so that the discharge electrodes of the ignition plug 16 can be prevented from being frequently exposed to a high temperature environment and consumption of the discharge electrodes can be minimized. FIG. 9 shows an effect how much consumption of the discharge electrode is actually suppressed. An upper graph shown in FIG. 9 illustrates how the driving condition is determined in order to perform a consumption test for the discharge electrodes. In a driving region (mode region) for daily use, the A/F ratio is often set to a lean side which is higher than the first threshold, in which the surface arc discharge is performed since the rotational speed and the load of the internal combustion engine is low. Meanwhile, in the case where a sudden acceleration is required, since the A/F ratio is often required to be set less than or equal to the first threshold, the surface streamer discharge is performed. Considering the above-described situation, a consumption test of the discharge electrodes is performed when the discharge period of the surface arc discharge and the discharge period of the surface streamer discharge are set as 8:2. In this case, as shown in lower part of FIG. 9, comparing with fuel combustion with only the surface arc discharge, the life of the electrode of the ignition plug 16 is extended to 1.25 times longer in the case where the surface arc discharge and the surface streamer discharge are switched to perform fuel combustion.

When the actual A/F ratio is less than or equal to the second threshold, the fuel can be stably combusted with only single surface streamer discharge. However, when the actual A/F ratio is higher than the second threshold and lower than or equal to the first threshold, the fuel may not be combusted only with single surface streamer discharge. Hence, the discharge period during one combustion cycle is extended by the timer signal generation unit 32, and thus the surface streamer discharge is performed multiple times. Accordingly, the surface streamer discharge is performed multiple times when the fuel may not be combusted with single streamer discharge because of the A/F ratio value, thereby reliably perform the fuel combustion.

When the actual A/F ratio is higher than the first threshold in lean side, the discharge control signal generating unit 34 outputs high signal to the OR circuit 39, thereby making total breakdown to cause the surface arc discharge. Thus, even when the actual A/F ratio is in a lean side, attempting fuel combustion by the surface arc discharge, ignitability can be enhanced.

The larger the rotational speed of the internal combustion engine, the faster the turbulent flow rate in the cylinder to increase the combustion rate. Therefore, since the combustion period itself is short, even when a short output period is set for the AC discharge, ignitability can be secured, and further consumption of the electrode can be minimized.

The larger the load of the internal combustion engine, the higher the pressure in the cylinder. Hence, it is difficult to discharge. Accordingly, setting the output period longer, the discharge is reliably performed, whereby ignitability can be secured.

The above-described embodiment can be modified as follows.

According to the above-described embodiment, the oscillator 35 generates a voltage signal having a frequency of approximately 800 KHz of AC voltage. This frequency is not limited to 800 KHz. Since an amount of inductance of the coil 18B and stray capacitance of the ignition plug 16 vary so that the resonant frequency varies as well, the frequency of the AC voltage is adjusted depending on variation of the resonant frequency.

According to the above-described embodiment, the second period is set to be 20 μsec. But the second period is not limited to 20 μsec. For example, when the AC voltage applied to the primary coil 18A varies, the second period where the discharge causes a total breakdown varies as well.

According to the above-described embodiment, the driving state is defined as a rotational speed and a load of the internal combustion engine. In this regard, an effective compression ratio of gas which exists in the cylinder or a tumble ratio (the number of rotations of tumble flow during the piston being reciprocated for one time) may be added to the above-described driving state. When the compression ratio is large, the temperature in the cylinder is increased so that the fuel is easy to combust. In this case, the first threshold and the second threshold can be set towards a lean side. When the tumble ratio in the cylinder is high, fuel and air can be well mixed so that the air-fuel mixture can be ignited easily. Therefore, likewise, the first and second thresholds can be set towards a lean side. Thus, taking the above-described driving state into consideration, suitable first and second thresholds can be set for a driving state of the internal combustion engine.

Figure 10:
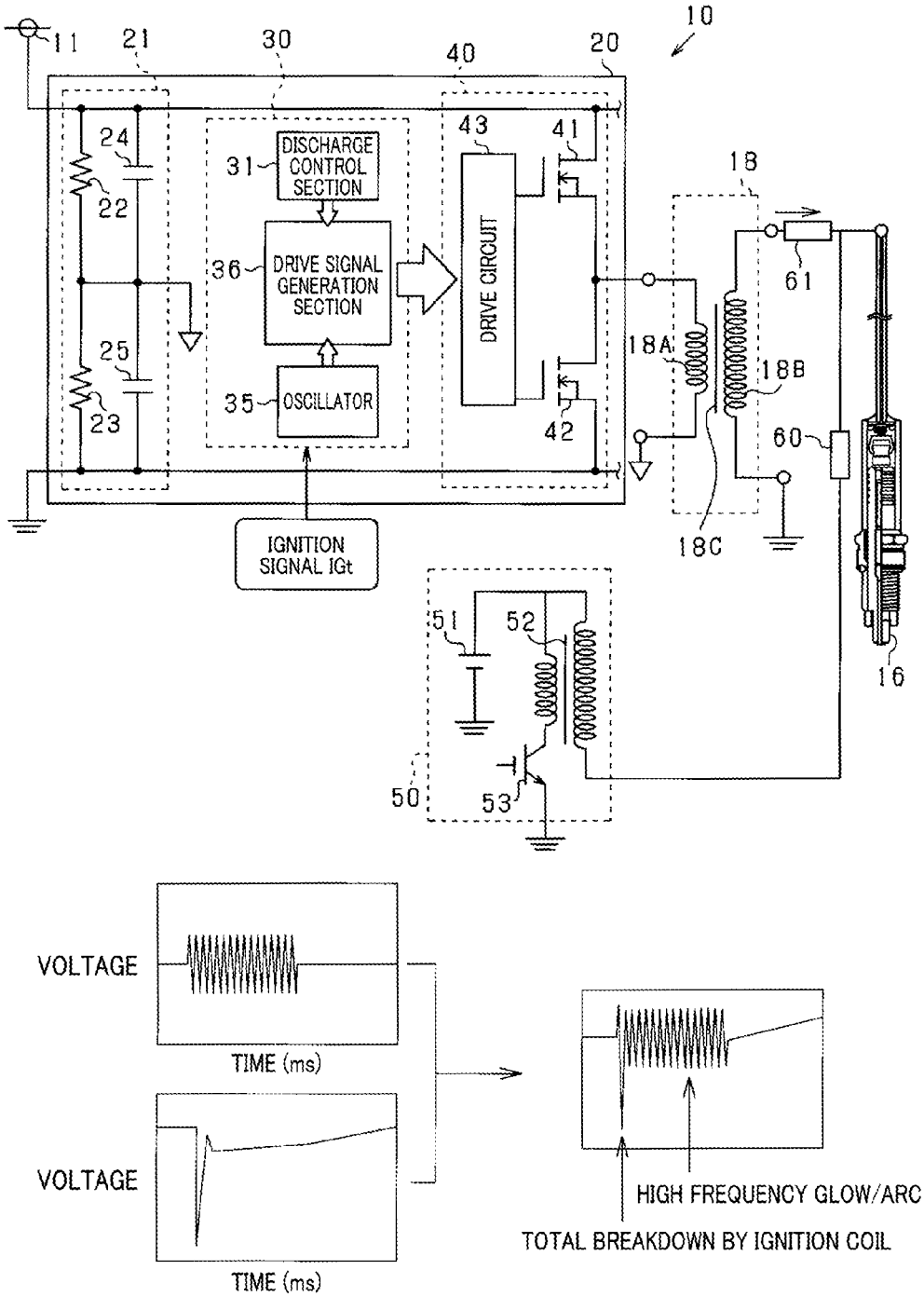
FIG. 10 is a graph showing an overall configuration of an ignition control system according to other example.

According to the above-described embodiment, output voltage of the high frequency power source 20 is applied to the primary coil 18A to cause discharge at the ignition plug 16. In this respect, as shown in FIG. 10, a high voltage applying unit (corresponding to high voltage source) 50 may additionally be disposed between the secondary coil 18B and the ignition plug 16. The high voltage applying unit 50 is provided with a second power source 51, a second ignition coil 52 and a third switching element 53. Accordingly, a backflow prevention element 60 such as a diode is provided between the ignition plug 16 and the high voltage applying unit 50 so as to prevent the secondary current generated by the ignition coil 18 from flowing through the high voltage applying unit 50. Similarly, a backflow prevention element 61 is provided between the high voltage applying unit 50 and the ignition coil 18 so as to prevent a secondary current generated by the second ignition coil 52 from flowing through the ignition coil 18.

In such a configuration, it is assumed that surface arc discharge is performed because the actual A/F ratio is on the lean side. In this case, a secondary voltage generated by the high voltage applying unit 50 is applied to the ignition plug 16, thereby enabling the discharge to be a total breakdown rapidly. Thereafter, the secondary voltage generated by the high frequency power source 20 is applied to the ignition plug 16. As a result, a period for generating the surface arc discharge can be shortened. Further, a time required for the fuel to combust can be shortened.

In this other embodiment, the AC voltage applied to the primary coil 18A from the high voltage applying unit 50 may be set such that the discharge produced at the ignition plug 16 reaches a partial breakdown but does not reach a total breakdown. Alternatively, the second period may be set longer than the ignition period of a combustion cycle of the internal combustion engine, in which the second period is set as a period that cases a total breakdown of the discharge. According to this configuration, a discharge control can be accomplished with simple conditions such that the high frequency power source 20 performs a discharge control when the actual A/F ratio is smaller than or equal to the first threshold, and the high voltage applying unit 50 and the high frequency power source 20 performs a discharge control when the actual A/F ratio larger than or equal to the first threshold.

What is claimed is:

1. An ignition device comprising:

an ignition plug that produces plasma discharge between a pair of discharge electrodes so as to ignite a combustible mixture in a combustion chamber of an internal combustion engine;

an ignition coil provided with a primary coil and a secondary coil, the secondary coil applying voltage between the pair of discharge electrodes of the ignition plug;

a voltage applying unit that applies alternating current voltage to the primary coil, a frequency of the alternating current voltage being set so as to produce voltage resonance in a circuit including the ignition plug and the secondary coil, wherein the voltage applying unit sets an output period of the alternating current voltage to be longer than a first period at which a partial breakdown start to occur due to a discharge at the pair of discharge electrodes, and shorter than a second period at which a total breakdown occurs due to a discharge at the pair of discharge electrodes, when an air/fuel ratio of the internal combustion engine is lower than a predetermined threshold.

2. The ignition device according to claim 1, wherein the predetermined threshold includes a first threshold and a second threshold; and the voltage applying unit outputs the alternating current voltage multiple times during the output period of one combustion cycle, when the air/fuel ratio of the internal combustion engine is lower than the first threshold and higher than the second threshold.

3. The ignition device according to claim 1, wherein the voltage applying unit sets the output period to be longer than the second period when the air/fuel ratio of the internal combustion engine is higher than the threshold.

4. The ignition device according to claim 1, wherein the voltage applying unit sets the output period such that the higher a rotational speed of the internal combustion engine, the shorter the output period.

5. The ignition device according to claim 1, wherein the voltage applying unit sets the output period such that the higher a load of the internal combustion engine, the longer the output period.

6. The ignition device according to claim 1, wherein the ignition device further includes a high voltage source that applies high voltage to the primary coil;

the high voltage source outputs the high voltage, when the air/fuel ratio of the internal combustion engine is higher than the threshold, to produce discharge between the pair of electrodes, thereby causing a total breakdown;

the voltage applying unit applies the alternating current voltage to the primary coil during the total breakdown due to the high voltage outputted by the high voltage source.

7. The ignition device according to claim 6, wherein the alternating current voltage is set in a range enabling the partial breakdown and disabling the total breakdown.

8. The ignition device according to claim 6, wherein the second period is set to be longer than an ignition period in a combustion cycle of the internal combustion engine.

9. The ignition device according to claim 1, wherein a streamer discharge is formed when the partial breakdown occurs caused by discharge between the pair of electrodes.

10. The ignition device according to claim 1, wherein a frequency of the voltage resonance is set to be 800 KHz.

11. The ignition device according to claim 1, wherein the second period is set to be 20 μsec.

* * * * *